United States Patent [19]

Kägeler et al.

[11] Patent Number: 4,710,066

[45] Date of Patent: Dec. 1, 1987

[54] METHOD AND APPARATUS FOR PNEUMATICALLY TRANSPORTING FILTER ROD SECTIONS AND THE LIKE

[75] Inventors: Peter Kägeler; Rudolf Bostelmann, both of Geesthacht; Olaf Buhrmester, Schwarzenbek, all of Fed. Rep. of Germany

[73] Assignee: Körber AG, Hamburg, Fed. Rep. of Germany

[21] Appl. No.: 794,097

[22] Filed: Nov. 1, 1985

[30] Foreign Application Priority Data

Nov. 17, 1984 [DE] Fed. Rep. of Germany ..... 3442168

[51] Int. Cl.[4] ..... B65G 51/02

[52] U.S. Cl. ..... 406/29

[58] Field of Search ..... 406/29–33; 131/282, 909; 198/347

[56] References Cited

U.S. PATENT DOCUMENTS

| | | | |
|---|---|---|---|
| Re. 28,383 | 4/1975 | Rudszinat . | |
| 3,336,085 | 8/1967 | Strydom | 406/33 |
| 3,614,166 | 10/1971 | Spitz | 406/33 |
| 3,797,890 | 3/1974 | Walters | 406/33 |
| 3,827,757 | 8/1974 | Heitmann et al. . | |
| 4,372,710 | 2/1983 | Kasparek et al. . | |

FOREIGN PATENT DOCUMENTS 1900149 4/1972 Fed. Rep. of Germany .

*Primary Examiner*—Jeffrey V. Nase
*Attorney, Agent, or Firm*—Peter K. Kontler

[57] ABSTRACT

A sender propels filter rod sections at a constant or at a variable frequency into a pneumatic conveyor which delivers the sections into the magazine of a receiver serving to store a supply of sections next to a filter tipping machine. The operation of the sender is interrupted for a fixed or for a variable interval of time after the sender propels a preselected number of sections. The intervals of operation and idleness of the sender are regulated in dependency on fluctuations of the quantity of sections in the magazine of the receiver. The frequency at which the sender propels the sections can be varied by varying the speed of a fluted rotor which transfers sections from a source to the sender, and the ratio of the intervals of operation and idleness of the sender is determined by several timing pulse generators which receive signals denoting the quantity of sections in the magazine and control the operation of a blocking device which can prevent the transfer of sections from the source into the sender.

14 Claims, 6 Drawing Figures

METHOD AND APPARATUS FOR PNEUMATICALLY TRANSPORTING FILTER ROD SECTIONS AND THE LIKE

BACKGROUND OF THE INVENTION

The present invention relates to a method of and to an apparatus for pneumatically transporting rodshaped articles, especially filter rod sections and other rod-shaped articles which constitute or form part of smoker's products. More particularly, the invention relates to improvements in methods and apparatus for transporting filter rod sections or the like from a sending station to a receiving station by way of a pneumatic conveyor. As used herein, the term "rod-shaped articles" is intended to embrace, among others, filter rod sections, plain cigarettes, cigarillos or cigars, filter cigarettes, cigarillos or cigars, cheroots and like articles wherein a tubular wrapper normally confines a mass of natural, reconstituted and/or substitute tobacco and/or filamentary, granular and/or other filter material.

It is customary to pneumatically transport rod-shaped articles of the tobacco processing industry between spaced-apart locations, e.g., from a filter rod making machine to a remote magazine which stores a supply of such articles adjacent to a filter tipping machine wherein filter rod sections are united with plain cigarettes to form filter cigarettes of unit length or multiple unit length. A sender at the sending station is designed to propel successive rod-shaped articles into the inlet of a pneumatic conveyor which can be several hundred meters long, and the outlet of the conveyor admits the articles into the magazine of the receiver. The sender can be designed to supply rod-shaped articles from a centrally located main storing or making station to two or more discrete filter tipping machines.

A sender which is presently preferred by many manufacturers of smokers' products is disclosed in commonly owned U.S. Pat. No. 3,827,757 to Heitmann et al. This sender is associated with means for transferring rod-shaped articles from a source of supply to a position of readiness for pneumatic propulsion into the inlet of the pneumatic conveyor. A receiver which can accept and temporarily store the thus propelled articles is disclosed in commonly owned U.S. Re. Pat. No. 28,383 to Rudszinat. The patented receiver is equipped with means for withdrawing successive rod-shaped articles from the pneumatic conveyor and for transferring them into the magazine.

A drawback of presently known pneumatic transporting systems for rod-shaped articles is that the admission of articles into the inlet of the pneumatic conveyor at regular intervals does not necessarily and invariably entail the arrival of such articles at the receiver at regular intervals. In many instances, the articles which are confined in the pneumatic conveyor accumulate into groups of closely adjacent articles. Consequently, the quantity of rod-shaped articles in the magazine of the receiver is likely to fluctuate within an excessive range, even if the sender is operated to intermittently admit articles at identical intervals. On the other hand, it is evidently desirable and advantageous to ensure that the receiver invariably contain a requisite quantity of rod-shaped articles so as to account for eventual fluctuations of the frequency at which the sender admits articles into the pneumatic conveyor, for eventual interruptions of operation of the sender, as well as for fluctuations in the rate at which the filter tipping machine or another processing machine consumes the articles which are transferred thereto from the magazine of the receiver.

Attempts to eliminate the aforediscussed problems in connection with the operation of heretofore known senders and receivers include the proposal to admit into the pneumatic conveyor predetermined quantities of rod-shaped articles per unit of time, namely quantities at least slightly exceeding the maximum anticipated quantities which are to be withdrawn from the magazine of the receiver, as long as the quantity of rod-shaped articles in the magazine is less than a prescribed minimum quantity, i.e., as long as the overall number of articles in the magazine is below a preselected threshold value. The quantity of articles in the magazine of the receiver is monitored by a detector which transmits a signal as soon as the level of the stored supply has reached a preselected maximum acceptable value or has descended below a minimum acceptable value. Signals which are generated by the detector are used to actuate a control unit which serves to regulate the operation of the sender, namely to select the number of articles which are propelled per unit of time in such a way that the sending of articles is interrupted when the supply of articles in the magazine has reached the aforementioned maximum permissible level, and that the transmission of articles is resumed when the level of the supply of stored articles has descended below the aforementioned minimum acceptable value.

German Auslegeschrift No. 1 900 149 discloses a proposal to avoid intermittent stoppage of the sender by equipping the apparatus with a blocking or arresting device which is responsive to signals from the monitoring means and serves to reduce the quantity of propelled articles per unit of time when the quantity of articles in the magazine of the receiver has risen to a preselected maximum value, and to increase the quantity of propelled articles per unit of time when the supply of articles in the magazine is depleted to a preselected minimum acceptable value. In other words, the blocking device can regulate the quantity of articles which reach the sender per unit of time in dependency on the extent to which the magazine of the receiver is filled with articles.

The proposal in the Auslegeschrift fails to address and/or solve the problems which arise as a result of the accumulation of propelled articles into groups before such articles reach the outlet of the pneumatic conveyor. The accumulation of articles into such groups entails their deceleration in the pneumatic conveyor and can lead to partial or complete clogging of the conveyor. The possibility of such clogging imposes limits upon the maximum permissible length of the pneumatic conveyor which, in presently known apparatus, is not in excess of 300 meters.

OBJECTS AND SUMMARY OF THE INVENTION

An object of the invention is to provide a novel and improved method of pneumatically transporting filter rod sections and other rod-shaped articles, especially rod-shaped articles of the tobacco processing industry, which reduces the likelihood of clogging of the pneumatic conveyor, which renders it possible to employ a longer pneumatic conveyor, and which can be practiced with conventional senders and receivers.

Another object of the invention is to provide a method which renders it possible to transmit to the receiving station larger quantities of articles per hour than in accordance with heretofore known methods.

A further object of the invention is to provide a method which can be practiced with simple, compact and reliable apparatus.

An additional object of the invention is to provide a novel and improved apparatus for the practice of the above outlined method.

Still another object of the invention is to provide the apparatus with novel and improved means for reducing the likelihood of accumulation of rod-shaped articles into groups during transport from the sending to the receiving station.

A further object of the invention is to provide an apparatus which can employ a pneumatic conveyor that is longer than the pneumatic conveyors of heretofore known apparatus.

An additional object of the invention is to provide the apparatus with novel and improved means for regulating the admission of rod-shaped articles into the inlet of the pneumatic conveyor as a function of fluctuations of the supply of such articles in the magazine of the receiver.

Another object of the invention is to provide an apparatus which can predictably transport larger quantities of rod-shaped articles than heretofore known apparatus without the danger of clogging of the pneumatic conveyor and without risking excessive fluctuations of the supply of articles at the receiving station.

One feature of the invention resides in the provision of a method of pneumatically conveying rod-shaped articles (particularly filter rod sections and other rod-shaped articles which constitute or form part of smokers' products) from a first or sending station to a second or receiving station. The method comprises the first step of intermittently propelling successive articles from the sending station to the receiving station by means of a gaseous fluid (e.g., by jets of compressed air), and a second step of repeatedly interrupting the first step upon completed propulsion of predetermined numbers of articles from the sending station. The first step includes propelling successive articles for first intervals of time, and the second step includes interrupting the first step for second intervals of time. Such method can further comprise the step of varying the ratio of the first and second intervals. Alternatively, the method can comprise the additional steps of maintaining the ratio of the first and second intervals at a constant value and varying the frequency at which the articles are propelled from the sending station during the first intervals. In accordance with such method, the first step can include establishing a supply of articles adjacent to the sending station and transferring successive articles from the supply to the sending station along an arcuate path (e.g., by a fluted rotor); the frequency varying step then comprises changing the speed at which the articles are transferred from the source to the sending station along the arcuate path (e.g., by changing the RPM of the rotor).

Another feature of the invention resides in the provision of an apparatus for pneumatically conveying rod-shaped articles, particularly filter rod sections and other rod-shaped articles which constitute or form part of smokers' products. The apparatus comprises a receiver, a pneumatic conveyor having an inlet and an outlet which is connected to the receiver, a source of articles, a sender which is connected to the inlet and has means for intermittently propelling into the conveyor by means of a gaseous fluid articles which are supplied by the source, and means for repeatedly interrupting the propulsion of articles by the sender upon completed propulsion of predetermined numbers of articles into the inlet.

The receiver preferably comprises a magazine which can store articles for delivery to a processing machine, e.g., to a filter tipping machine. The source of articles includes means for transferring articles to the sender. In such apparatus, the interrupting means can comprise means for monitoring the quantity of articles in the magazine of the receiver and for generating signals which denote the monitored quantities, and means for timing the intervals of operation and idleness of the sender in response to the signals. The monitoring means can include a plurality of detectors (e.g., two photoelectronic detectors) which are adjacent to the magazine of the receiver and are disposed at different levels.

The apparatus can further comprise means for blocking the delivery of articles from the source to the sender by way of the transferring means, and the timing means can comprise means for activating the blocking means in response to the signals from the detectors so that the blocking means is activated at longer or shorter intervals (i.e., at a greater or lesser frequency) and/or for shorter or longer periods of time. The activating means can comprise motor means for moving the blocking means relative to the article transferring means and a plurality of timing pulse generators whose inputs are connected to the detectors and whose outputs are connected to the motor means. The timing pulse generators are designed to operate the motor means for different intervals of time in response to signals denoting different quantities of articles in the magazine of the receiver. The activating means can further comprise discrete signal amplifier means for each detector, a discrete threshold circuit between each of the amplifier means and the timing pulse generators, a discrete AND gate between the threshold circuits and each timing pulse generator, and an OR gate connected between the outputs of the timing pulse generators and the motor means which can include a relay energizable by signals from the OR gate.

The transferring means can include a rotor and variable-speed motor means for the rotor. The timing means can include means for varying the speed of the motor in response to signals from the monitoring means so that the frequency at which the rotor transfers articles from the source to the sender is changed when the monitoring means detects that the supply of articles in the magazine of the receiver has risen above or has descended below one or more preselected levels. The means for varying the speed of the motor for the rotor can be provided in addition to the aforediscussed timing means.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
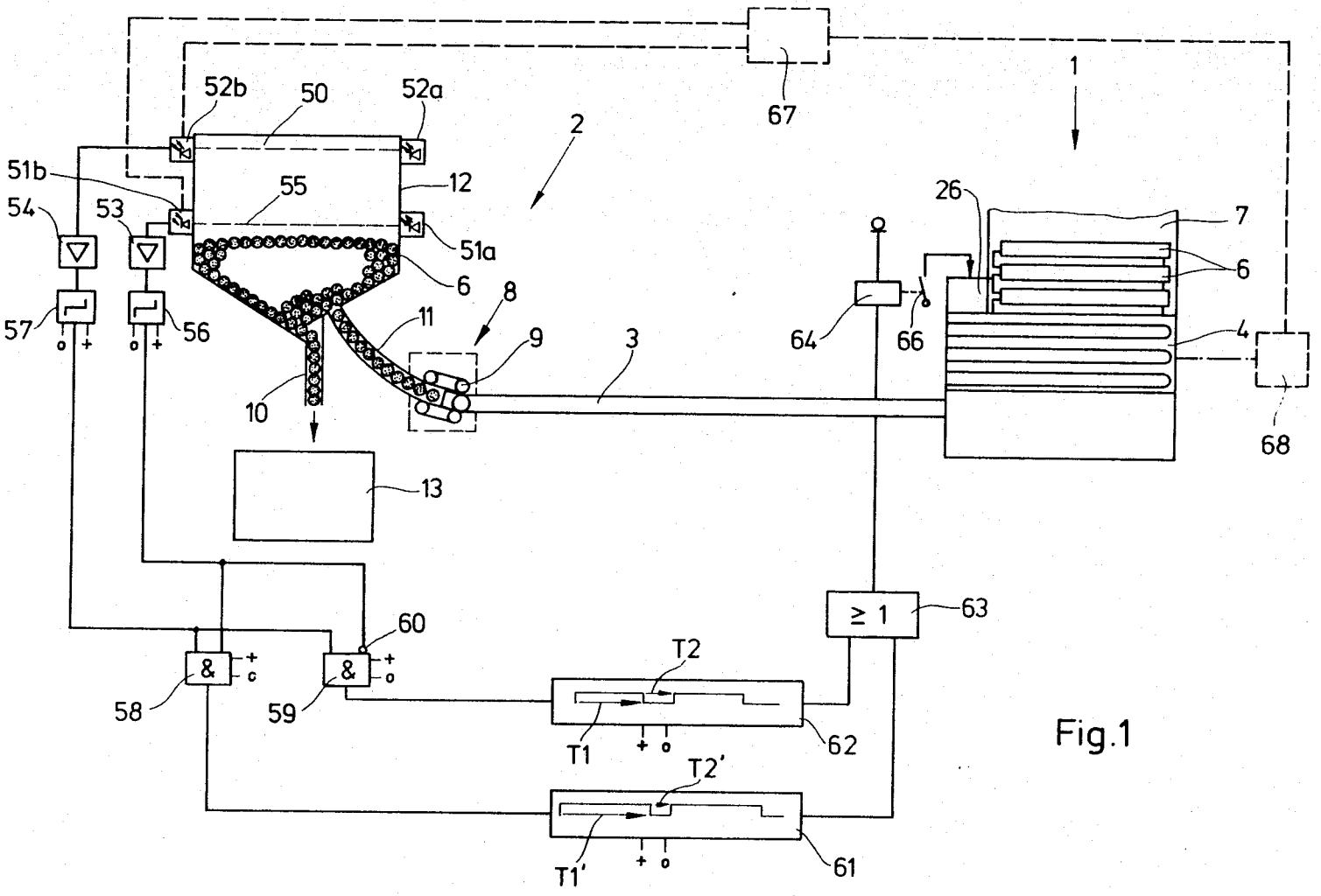
FIG. 1 is a diagrammatic view of an apparatus which embodies one form of the invention and wherein the timing means comprises two timing pulse generators, the means for varying the rotational speed of the rotor which transfers articles from the source to the sender being indicated by broken lines.

Referring first to FIG. 1, there is shown an apparatus which comprises a sender 1 at a sending station, a receiver 2 at a remote receiving station, and a pneumatic conveyor 3 whose outlet is connected with the receiver 2 and whose inlet receives rod-shaped articles 6 (e.g., filter rod sections of multiple unit length) from the sender 1. The sender 1 receives articles 6 from a source 7 (e.g., a hopper of the type shown in the upper portion of FIG. 3), and the means for transferring such articles from the source 7 to the propelling or sending location B in the sender 1 comprises a drum-shaped rotor 4 having axially parallel peripheral receiving means in the form of flutes 14. The sender 1 has means for propelling successive articles 6 by blasts of compressed air so that such articles enter the inlet of the conveyor 3 and advance toward the receiver 2. The articles 6 in the conveyor 3 move axially but the direction of their movement is changed from longitudinal to sidewise before they enter the magazine 12 of the receiver 2. The latter comprises an article accelerating unit 8 which has means for imparting to successive oncoming articles a predetermined speed, which establishes between successive accelerated articles 6 gaps 30 of predetermined width (see FIG. 5) and delivers the thus accelerated and spaced-apart articles to an inserting unit 9 which moves successively delivered articles sideways through a duct 11 and into the magazine 12. The magazine 12 has an outlet 10 which can admit articles 6 to a consumer 13, e.g., to a filter tipping machine known as MAX or MAX S (manufactured by the assignee of the present application).

Figure 2:
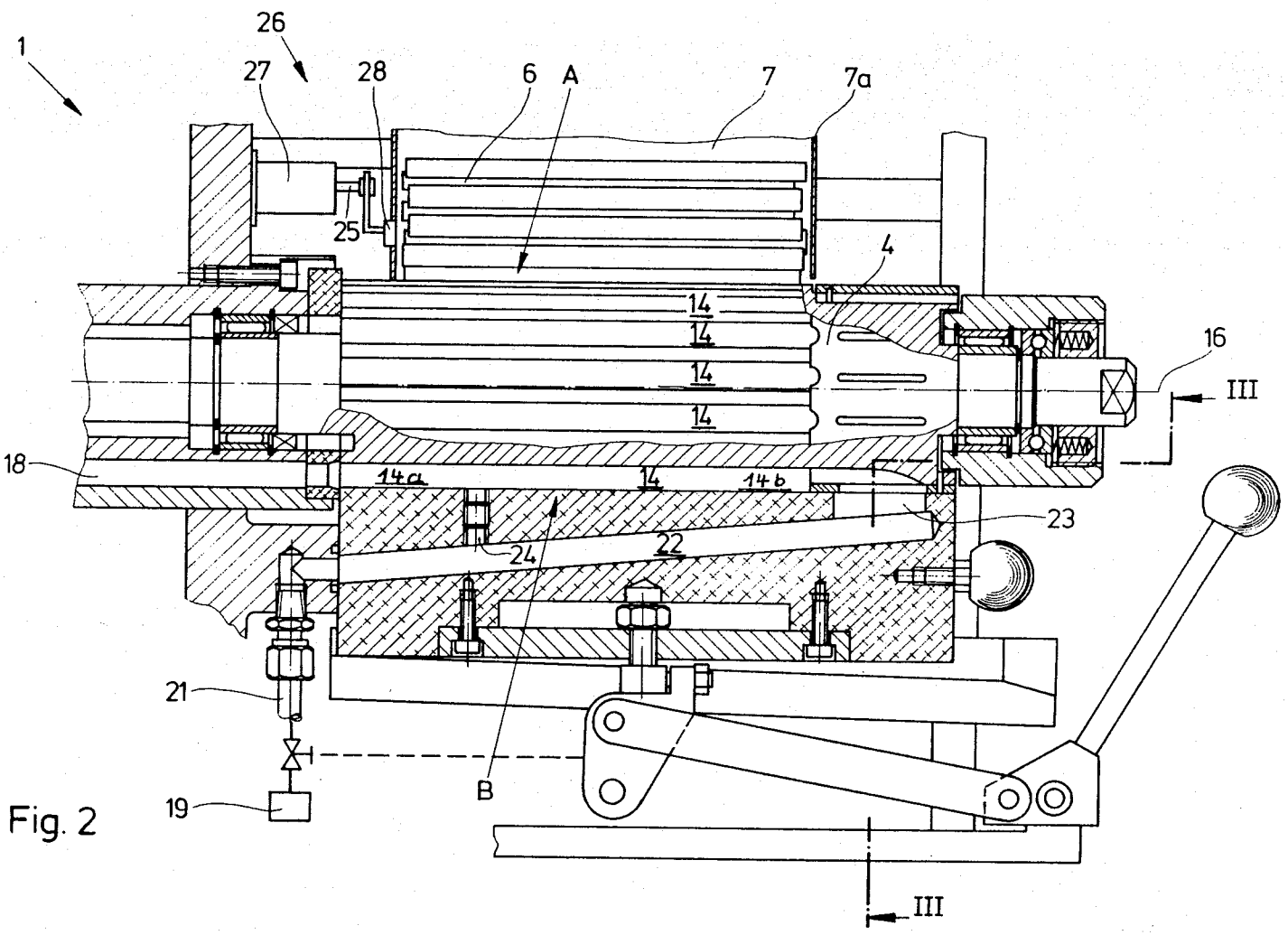
FIG. 2 is an enlarged fragmentary sectional view of a sender which can be utilized in the apparatus of FIG. 1.
Figure 3:
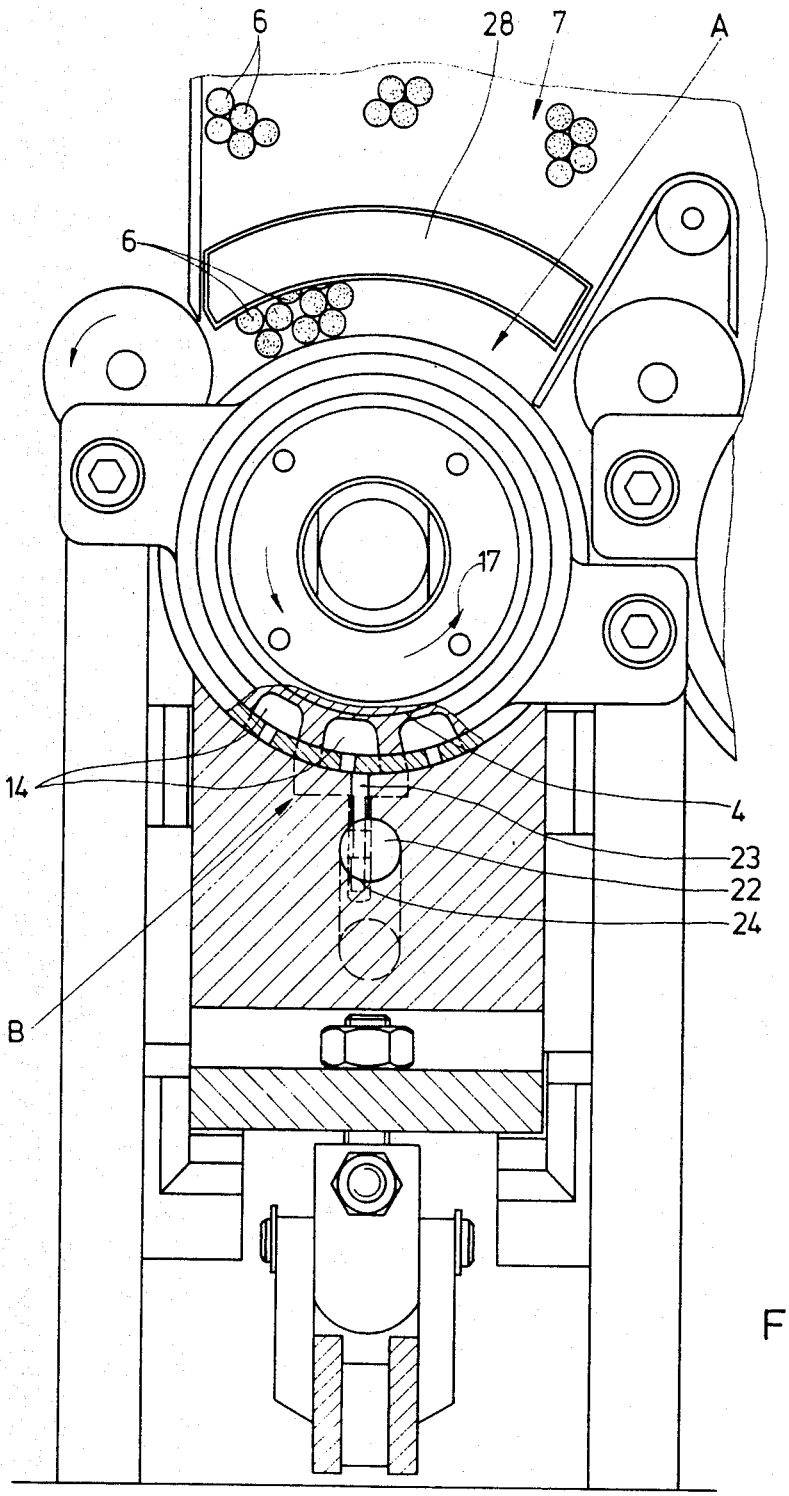
FIG. 3 is an enlarged sectional view as seen in the direction of arrows from the line III—III of FIG. 2.

Certain details of the sender 1 are shown on a larger scale in FIGS. 2 and 3. This sender is substantially identical with that which is disclosed in the aforementioned patent to Heitmann et al. whose disclosure is incorporated herein by reference. The flutes 14 of the rotor 4 transport rod-shaped articles 6 sideways from the lower part of the hopper 7 (at A) along an arcuate path whose center of curvature is located on the axis 16 of the rotor 4. The rotor 4 is driven to rotate in the direction which is indicated by the arrow 17 (FIG. 3) and to deliver the articles 6 to the location B behind a stationary channel 18. An article 6 which is admitted into the channel 18 is moved axially to enter the inlet of the pneumatic conveyor 3. The unit which serves to propel articles 6 from the channel 18 into the conveyor 3 comprises a source 19 of compressed air which is connected with a channel 22 by a conduit 21. The channel 22 admits compressed air to two conduits 23 and 24. The conduit 24 admits compressed air into the front and rear end portions 14*a* and 14*b* of the flute 14 at the propelling station, i.e., at the front and rear ends of the article 6 which is ready to be propelled into the channel 18 and thence into and beyond the inlet of the conveyor 3. Such equalization of pressures at the ends of the article 6 which is ready for propulsion into the conveyor 3 prevents abrupt propulsion of the article at the location B in a direction counter to that of intended propulsion into the channel 18 and conveyor 3 due to the elevated pressure which prevails in the conveyor 3. Compressed air which is supplied by the conduit 23 serves to propel the article 6 at the location B toward and into the channel 18 as soon as the corresponding flute 14 moves into register with the channel 18.

The apparatus further comprises a blocking or arresting device 26 which can interrupt the transfer of articles 6 from the hopper 7 by the rotor 4. The arresting device 26 comprises a plate-like blocking member 28 which is reciprocable by the reciprocable armature 25 of a motor here shown as an electromagnet 27 mounted in the frame of the sender 1 adjacent to the lower part A of the hopper 7. When the electromagnet 27 is energized or deenergized (i.e., when the electromagnet changes its condition), the armature 25 shifts the blocking member 28 in a direction to the right, as viewed in FIG. 2, whereby the blocking member 28 bears against the adjacent end faces of the articles 6 in the lower part A of the hopper 7 and urges the other end faces of the thus engaged articles against the inner side of the stationary hopper wall 7*a*. The rotor 4 is free to rotate but its flutes 14 cease to receive articles 6 from the hopper 7 as long as the armature 25 maintains the blocking member 28 in the operative position. The blocking member 28 can be made of or can be coated with an elastomeric material, e.g., rubber.

Figure 4:
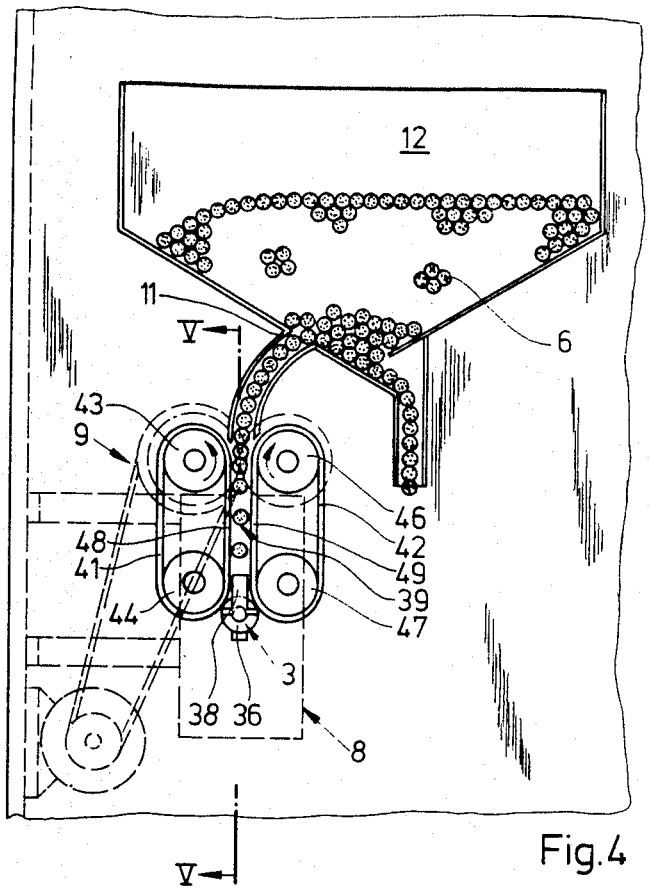
FIG. 4 is an enlarged view of a receiver which can be used in the apparatus of FIG. 1.
Figure 5:
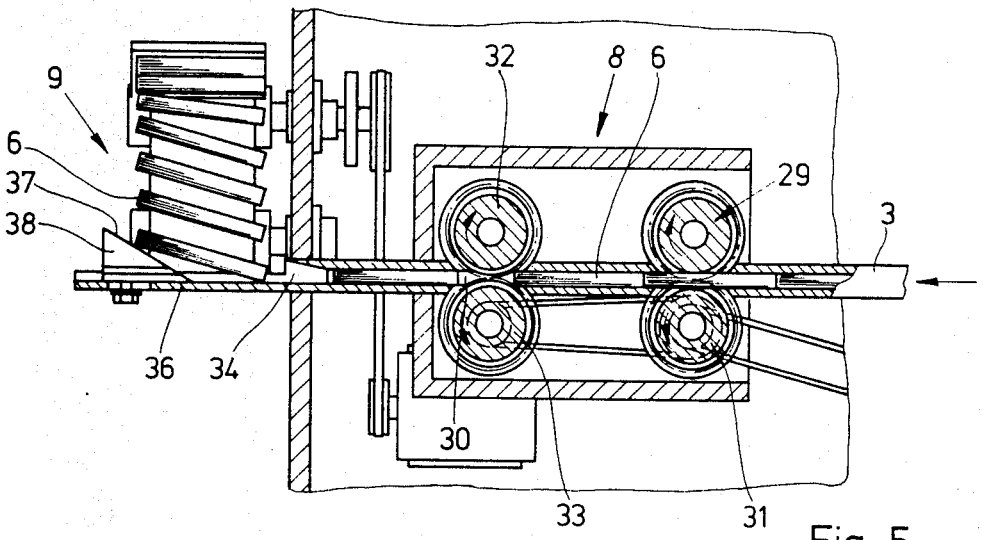
FIG. 5 is a sectional view as seen in the direction of arrows from the line V—V of FIG. 4.

Certain details of the receiver 2 (which is or can be identical with the receiver disclosed in the aforementioned patent to Rudszinat) are shown in FIGS. 4 and 5.

As already explained above, the articles 6 which advance in, and reach the outlet of, the pneumatic conveyor 3 are engaged by the accelerating unit 8 (FIG. 5) which includes a first pair of driven rollers 29, 31 and a second pair of driven rollers 32, 33. The rollers 29, 31 serve to impart to successive articles 6 a predetermined speed (which can exceed or can be less than the speed of oncoming articles 6 and is dependent on the peripheral speed of the rollers 29, 31). Successive articles 6 which are advanced by the rollers 29, 31 are thereupon accelerated to a predetermined speed by the rollers 32, 33 so that the accelerated articles 6 form a file with the aforementioned gaps 30 therebetween. The ratio of the peripheral speeds of the rollers 29, 31 and 32, 33 will determine the width of the gaps 30, and such width is selected with a view to ensure that successive accelerated articles 6 can change the direction of their movement from longitudinal movement to sidewise (transverse) movement without any interference, i.e., the leader of a next-following accelerated article cannot prevent sidewise movement of the preceding accelerated article. The rims of the rollers 29, 31, 32 and 33 can be made of or can be coated with a suitable friction generating material.

The accelerated articles 6 advance through a discharge opening 34 and enter a channel 36 to slide along the suitably inclined face 37 of a wedge-like cam 38 which causes the lifted leaders of successive accelerated articles to enter the space between the adjacent reaches 48, 49 of two endless belt conveyors 41, 42. These reaches define a passage 39 whose width is slightly less than the diameter of an article 6 so that the articles are positively engaged and move sideways into a suitably curved duct 11 leading into the lower portion of the magazine 12. The belt conveyors 41, 42 constitute component parts of the aforementioned inserting unit 9 which is shown in FIG. 4, and such belt conveyors are respectively trained over pulleys 43, 44 and 46, 47. The manner in which the belt conveyors 41, 42 are driven and other details of the receiver 2 are the same as disclosed in the patent to Rudszinat whose disclosure is incorporated herein by reference. A modified receiver is disclosed in commonly owned U.S. Pat. No. 4,372,710 to Kasparek et al.

Referring again to FIG. 1, the apparatus further comprises means for monitoring the quantity of articles 6 in the magazine 12 of the receiver 2 and for generating signals which denote the monitored quantity. The illustrated monitoring means comprises two photoelectronic detectors including an upper detector having a radiation source 52*a* and a transducer 52*b* which latter transmits signals as long as the top surface of the supply of articles 6 in the magazine 12 is below the level 50 (denoted by a broken line), and a lower detector including a radiation source 51*a* and a transducer 51*b* which transmits signals as long as the top surface of the supply of articles in the magazine 12 is below the lowermost permissible level 55 (also denoted by a broken line). The outputs of the transducers 51*b*, 52*b* are respectively connected with amplifiers 53, 54 whose outputs, in turn, are connected with threshold circuits 56, 57. The outputs of the threshold circuits 56, 57 are connected with the corresponding inputs of two AND gates 58, 59. That input of the AND gate 59 which receives signals from the output of the threshold circuit 56 is provided with an inverter 60.

The outputs of the AND gates 58, 59 are respectively connected with the inputs of timing pulse generators 61, 62 whose outputs are connected to the corresponding inputs of an OR gate 63. The output of the OR gate 63 is connected with a relay 64 serving as a means for closing or opening a switch 66 in the circuit of the electromagnet 27, i.e., of the motor means for the blocking member 28 of the arresting device 26.

The mode of operation of the apparatus of FIG. 1 is as follows:

The rotational speed of the rotor 4 is selected with a view to at least match but to preferably exceed the maximum requirements of the consuming machine 13, i.e., to deliver the articles 6 to the location B at a maximum rate. It is assumed that the monitoring means including the detectors 51*a*, 51*b* and 52*a*, 52*b* transmits signals denoting that the actual level of the supply of articles 6 in the magazine 12 is below the level 55, i.e., that the supply of such articles has been depleted below the minimum acceptable value and that it is necessary to replenish such supply. Since the paths for the beams of radiation from the radiation sources 51*a*, 52*a* to the respective transducers 51*b*, 52*b* are not obstructed by the articles 6 in the magazine 12, the outputs of the transducers 51*b*, 52*b* transmit signals which are amplified at 53, 54 and enable the AND gate 58 to transmit a signal to the input of the associated timing pulse generator 61. The AND gate 59 cannot transmit a signal to the associated timing pulse generator 62 because the inverter 60 prevents the transmission of signals from the threshold circuit 56 to the right-hand input of the gate 59. The timing pulse generator 61 transmits relatively long pulses T1 which cause the relay 64 to maintain the switch 66 in open position so that the electromagnet 27 is deenergized and cannot maintain the blocking member 28 in the operative position in which the transfer of articles 6 from the hopper 7 to the location B is interrupted. The long pulses T1 alternate with shorter pulses T2 which cause the relay 64 to energize the electromagnet 27 via switch 66 so that the blocking member 28 then interrupts the transfer of articles 6 from the lower part A of the hopper 7. In other words, the timing pulse generator 61 ensures that the sender 1 propels a predetermined number of articles 6 into the pneumatic conveyor 3 during a relatively long interval of time which is determined by the duration of the timing pulse T1, that the propulsion of articles 6 into the inlet of the conveyor 3 is thereupon interrupted for a relatively short interval of time which is determined by the duration of the pulse T2, that the sender 1 thereupon again propels a predetermined number of articles 6 during the next-following interval which is determined by the duration of the next pulse T1, that the propulsion of articles is interrupted for a relatively short interval of time which is determined by the duration of the next pulse T2, and so forth. Thus, the timing pulses T1 determine the length of those intervals during which the blocking device 26 is idle, and the timing pulses T2 determine the length of those intervals during which the blocking device 26 is active.

When the supply of articles 6 in the magazine 12 of the receiver 2 is replenished to such an extent that the top layer or layers of articles in the magazine 12 rise to or above the level 55, the transducer 51*b* ceases to transmit signals to the amplifier 53 and to the threshold circuit 56 so that the output of the AND gate 58 ceases to energize the timing pulse generator 61 but the output of the AND gate 59 transmits a signal to the input of the timing pulse generator 62 because the inverter 60 begins to transmit a signal as soon as the transmission of signals from the transducer 51*b* is interrupted. The timing pulse generator 62 transmits relatively short timing pulses T1′ (in comparison with the duration of a timing pulse T1) during which the blocking device 26 is idle and relatively long timing pulses T2′ (in comparison with the duration of a timing pulse T2) during which the device 26 is operative to prevent the transfer of articles 6 from the hopper 7 to the location B behind the channel 18 and the inlet of the pneumatic conveyor 3. Thus, the number of articles 6 which are propelled during the intervals determined by successive timing pulses T1′ is reduced and the length of intervals of interruption of propulsion of articles 6 into the conveyor 3 is increased so that the total number of articles 6 which reach the magazine 12 during successive intervals corresponding to the combined duration of a pulse T1′ and a pulse T2′ is reduced. The duration of pulses T2′ need not necessarily be shorter than the duration of pulses T2, as long as the pulses T1′ are shorter than the pulses T1, or vice versa.

It has been found that the provision of timing pulse generators 61 and 62 actually increases the overall output of the sender 1 in spite of the establishment of intervals between successive propulsions of predetermined numbers of articles 6, such numbers being determined by the speed of the rotor 4 (this speed can remain constant regardless of whether the operation of the blocking device 26 is regulated by the timing pulse generator 61 or 62) and by the level of the supply of articles 6 in the magazine 12 of the receiver 2. The ratio of durations of pulses T1, T2 or T1′, T2′ can be varied so as to ensure that the rate of admission of articles 6 into the magazine 12 during a reasonably long period of time will match the rate at which such articles are consumed or processed by the machine 13. The apparatus of FIG. 1 can comprise three or more timing pulse generators and a correspondingly increased number of photoelectronic or otherwise designed detectors which monitor the supply of articles 6 in the magazine 12. Alternatively, the apparatus can employ a single timing pulse generator which replaces the timing pulse generators 61, 62 and is adjustable so that the ratio of the duration of pulses T1 or T1' to the duration of pulses T2 or T2' can be altered in response to modified signals from the monitoring means including the detectors for the supply of articles in the magazine 12. The apparatus can employ an infinitely variable timing pulse generator which can respond to continuously varying signals from one or more detectors, e.g., from a sensor which rests on the top surface of the supply of articles 6 in the magazine 12 and causes a potentiometer or another suitable signal transmitting device to continuously vary the intensity of the signal to the infinitely variable timing pulse generator in dependency on any and all fluctuations of the level of the supply of articles in the magazine 12.

Figure 6:
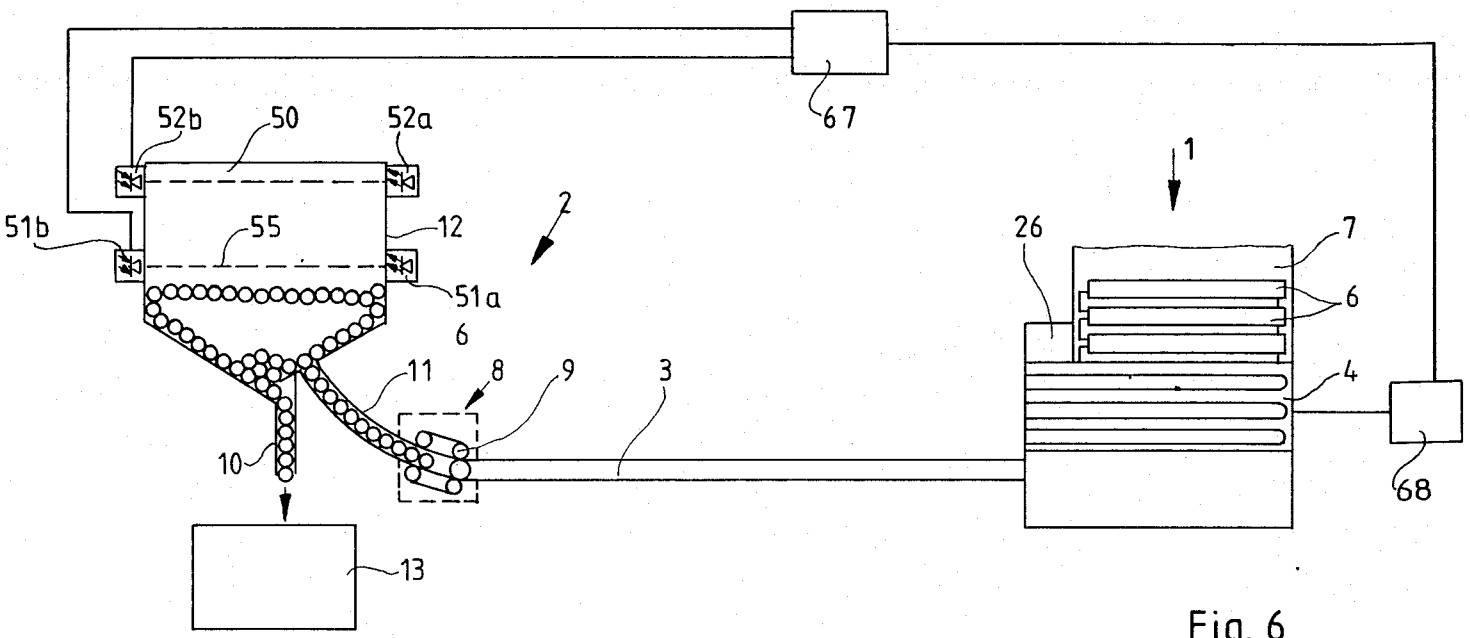
FIG. 6 is a diagrammatic view of a modified apparatus.

In accordance with a modification which is shown in FIG. 6, the apparatus of the present invention can be designed in such a way that the ratio of the duration of timing pulses T1 to T2 or T1' to T2' remains unchanged but the apparatus changes the quantity of articles 6 which are transferred from the hopper 7 to the location B during each of the intervals which is determined by the timing pulses T1 or T1'. The component parts of such modified apparatus are shown in FIG. 1 by broken lines. They include a variable-speed prime mover (e.g., an electric motor) 68 for the rotor 4 and a control circuit 67 which receives signals from the transducers **51*b*, 52*b* and regulates the speed of the motor 68 (and hence the speed of the rotor 4) in dependency on changes in the quantity of articles 6 in the magazine 12. Thus, the speed of the motor 68 is increased when the transducers 51*b*, 52*b* transmit signals denoting that the supply of articles 6 in the magazine 12 is depleted, and the speed of the motor 68 is reduced when the signals from the transducers indicate that the quantity of stored articles is on the increase. The apparatus including the motor 68 and the control circuit 67 is relatively simple and is less likely to affect the appearance of the articles because such articles need not be repeatedly engaged and released by the blocking member 28 if the length of intervals during which the coveyor 3 does not receive any articles 6 is determined by the motor 68 which simply stops the rotor 4 during the intervals corresponding to those determined by the timing pulses T2 or T2'. Alternatively, the motor 68 and the control circuit 67 can be used in addition to the timing pulse generators 61, 62 or analogous timing pulse generating means in order to even more rapidly change the quantity of articles 6 in the magazine 12 in response to fluctuations of the upper level of the supply of such articles in the receiver 2**.

An important advantage of the improved method and apparatus is that the likelihood of accumulation of groups of abutting articles 6 in the pneumatic conveyor 3 is reduced or eliminated in a very simple but highly efficient way by the expedient of intermittently interrupting the propulsion of articles 6 into the conveyor 3 after each propulsion of a preselected number of articles. Thus, the improved method and apparatus rely on an interruption of the propulsion of articles which is superimposed upon the inherently intermittent operation of the sender 1. The operation is such that the propulsion of a predetermined number of articles 6 is followed by an interval of no propulsion at all, regardless of the extent to which the magazine 12 of the receiver 2 is filled with articles. As mentioned above, such mode of operation raises the output of the improved apparatus above the outputs of the aforediscussed conventional apparatus in spite of the fact that the intervals of propulsion are always followed by intervals of no propulsion at all. The reason for the achievement of a higher output is believed to be that the aforediscussed mode of operation (according to which intervals of propulsion alternate with intervals during which the conveyor 3 does not receive any rod-shaped articles) greatly reduces at least the likelihood of accumulation of long groups of abutting articles and attendant deceleration of articles in the conveyor 3.

Another important advantage of the improved method and apparatus is that it is now possible to transport rod-shaped articles through distances greatly exceeding the heretofore achievable maximum distances of approximately 300 meters. The quantity of articles which are being delivered to the receiver 2 can be caused to conform to the quantity of articles which are consumed by the machine 13, and this can be achieved without necessarily changing the RPM of the rotor 4 which transfers articles from the source (hopper 7) to the sender 1.

An additional important advantage of the improved apparatus is that any malfunctioning of the receiver 2 can be eliminated during the intervals of non-propulsion of articles into the pneumatic conveyor 3 so that it is not necessary to carry out the maintenance or repair work in or on the receiver while the latter is operated manually (this is the customary procedure in conventional apparatus).

The transducers **51*b*, 52*b* transmit signals when they are exposed to radiation issuing from the respective light sources. If the transducers are designed to transmit signals when not exposed to light or another type of radiation (e.g., of the type known as LS 5/7Ga manufactured by Visolux, Berlin, German Federal Republic), the illustrated inverter 60 is replaced with three inverters, one for the left-hand input of the AND gate 59 and the other two for the two inputs of the AND gate 58**.

The timing pulse generators 61, 62 may be of the type known as Sigmatronic PR3, manufactured by BBC.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of pneumatically conveying rod-shaped articles, particularly sections of filter rods and other articles which constitute or form part of smokers' products, from a sending station to a receiving station, comprising a first step of intermittently propelling successive articles from the sending to the receiving station by a gaseous fluid; and a second step of repeatedly interrupting the first step upon completed propulsion of predetermined numbers of articles from the sending station so that first intervals of propulsion of articles continuously alternate with second intervals of interruption of propulsion of articles regardless of the quantity of articles at the receiving station.

2. The method of claim 1, further comprising the step of varying the ratio of said first and second intervals.

3. The method of claim 1, further comprising the step of maintaining the ratio of said first and second intervals at a constant value.

4. The method of claim 3, further comprising the step of varying the frequency at which the articles are propelled from the sending station during said first intervals.

5. The method of claim 4, wherein said first step includes establishing a supply of articles adjacent to the sending station and transferring successive articles from the supply to the sending station along an arcuate path, said frequency varying step including changing the speed at which the articles are transferred along said arcuate path.

6. Apparatus for pneumatically conveying rod-shaped articles, particularly sections of filter rods and other articles which constitute or form part of smokers' products, comprising a receiver; a pneumatic conveyor having an inlet and an outlet which is connected to said receiver; a source of articles; a sender connected to said inlet and having means for intermittently propelling into said conveyor by a gaseous fluid articles which are supplied by said source; and means for repeatedly interrupting the propulsion of articles by said sender upon completed propulsion of predetermined numbers of articles into said inlet so that first intervals of propulsion continuously alternate with second intervals of interruption of propulsion of articles regardless of the quantity of articles in said receiver.

7. The apparatus of claim 6, wherein said receiver comprises a magazine for articles and said source includes means for transferring articles to said sender, said interrupting means including means for monitoring the quantity of articles in said magazine and for generating signals denoting the monitored quantity, and means for timing the intervals of operation and the intervals of idleness of said sender in response to said signals.

8. The apparatus of claim 7, wherein said monitoring means includes a plurality of detectors which are adjacent to said magazine and are disposed at different levels.

9. The apparatus of claim 8, wherein at least one of said detectors is a photoelectronic detector.

10. The apparatus of claim 7, further comprising means for blocking the delivery of articles from said source to said sender by way of said transferring means, said timing means comprising means for activating said blocking means in response to said signals.

11. The apparatus of claim 7, wherein said transferring means includes a rotor and variable-speed motor means for said rotor, said timing means including means for varying the speed of said motor in response to said signals.

12. The apparatus of claim 7, wherein said transferring means includes a rotor and a variable-speed motor for said rotor, and further comprising means for varying the speed of said motor in response to said signals.

13. Apparatus for pneumatically conveying rod-shaped articles, particularly sections of filter rods and other articles which constitute or form part of smokers' products, comprising a receiver including a magazine for articles; a pneumatic conveyor having an inlet and an outlet which is connected to said receiver; a source of articles; a sender connected to said inlet said source including means for transferring articles to said sender and said sender having means for intermittently propelling into said conveyor by a gaseous fluid articles which are supplied by said source; means for repeatedly interrupting the propulsion of articles by said sender upon completed propulsion of predetermined numbers of articles into said inlet, said interrupting means including means for monitoring the quantity of articles in said magazine and for generating signals denoting the monitored quantity, and means for timing the intervals of operation and the intervals of idleness of said sender in response to said signals; and means for blocking the delivery of articles from said source to said sender by way of said transferring means, said timing means comprising means for activating said blocking means in response to said signals, said monitoring means including a plurality of detectors and said activating means including motor means for moving said blocking means relative to said transferring means and a plurality of timing pulse generators having inputs connected to said detectors and outputs connected to said motor means, each of said pulse generators being arranged to operate said motor means for different intervals of time in response to signals denoting different quantities of articles in said magazine.

14. The apparatus of claim 13, wherein said activating means further comprises discrete signal amplifier means for each of said detectors, a discrete threshold circuit installed between each of said amplifier means and said timing pulse generators, a discrete AND gate connected between said threshold circuits and each of said timing pulse generators, and an OR gate connected between the outputs of said timing pulse generators and said motor means, said motor means including a relay which is energizable by signals transmitted by said OR gate.

* * * * *